US007770887B2

(12) United States Patent
Park et al.

(10) Patent No.: US 7,770,887 B2
(45) Date of Patent: Aug. 10, 2010

(54) PAPER MONEY GUIDE APPARATUS

(75) Inventors: Chang Ho Park, Gunpo-si (KR); Kyong Tae Lee, Suwon-si (KR); Gun Chang Lee, Daegu (KR)

(73) Assignee: Nautilus Hyosung Inc., Seoul (KR)

( * ) Notice: Subject to any disclaimer, the term of this patent is extended or adjusted under 35 U.S.C. 154(b) by 302 days.

(21) Appl. No.: 11/768,987

(22) Filed: Jun. 27, 2007

(65) Prior Publication Data

US 2008/0001349 A1 Jan. 3, 2008

(30) Foreign Application Priority Data

Jun. 30, 2006 (KR) ..... 10-2006-0061396

(51) Int. Cl.
*B65H 1/00* (2006.01)

(52) U.S. Cl. ..... 271/171; 271/223

(58) Field of Classification Search ..... 271/171, 271/223

See application file for complete search history.

(56) References Cited

U.S. PATENT DOCUMENTS 5,632,477 A * 5/1997 Morinaga ..... 271/127

5,815,787 A * 9/1998 Crayton et al. ..... 399/393

* cited by examiner

*Primary Examiner*—Patrick Mackey
*Assistant Examiner*—Michael C McCullough
(74) *Attorney, Agent, or Firm*—Fish & Richardson P.C.

(57) ABSTRACT

The present invention relates to a paper money guide apparatus of an ATM, and more particularly, and it is an object of the present invention to provide a paper money guide apparatus of an ATM that can adjustably guide various kinds of paper money having different widths by a simple structure.

In order to achieve the object, according to an aspect of the present invention, a paper money guide apparatus of an automatic teller machine guides ends of paper money when paper money stacked in a paper money stacking space is moved by a transfer plate. The paper money guide apparatus includes paper money guide plates that each include a guide piece guiding an end of the paper money and a positioning part being detachably positioned in a width direction of the paper money depending on the width of the paper money.

6 Claims, 14 Drawing Sheets

PAPER MONEY GUIDE APPARATUS

BACKGROUND OF THE INVENTION

1. Field of the Invention

The present invention relates to a paper money guide apparatus of an ATM (automatic teller machine), and more particularly, to a paper money guide apparatus that can adjustably guide various kinds of paper money having different widths.

2. Description of the Related Art

In general, a cash dispenser unit (CDU) and a billing recycling machine (BRM) have been used as automatic teller machines that quickly and conveniently provide various financial services at anytime without consulting with a person. The CDU has been used since the financial services have been computerized, and is used to withdraw only cash. The BRM has a deposit function in addition to a cash dispensing function.

FIG. 1 is a schematic view showing a structure of a known ATM, and FIGS. 2A and 2B are schematic side and plan views of a deposit/withdrawal unit.

An automatic teller machine includes a deposit/withdrawal unit 10 into/from which a client puts or withdraws paper money, a conveyance path 20 on which the paper money to be put into or withdrawn from the deposit/withdrawal unit 10 is transferred, a discriminating unit 30 that is provided on the conveyance path 20 and discriminates paper money, a temporary storing unit 40 in which paper money deposited through the discriminating unit 30 is temporarily loaded, and a plurality of recycleboxes 50 where paper money deposited by a client is loaded and withdrawn to be circulated.

Each of the deposit/withdrawal unit 10 and the temporary storing unit 40 has a paper money stacking space 12 in which paper money is stacked. The paper money stacking space 12 is divided into a first paper money stacking space 12*a* and a second paper money stacking space 12*b*, which are formed on right and left sides of a stack plate 13, and a transfer plate 14 is provided on the right side of the second paper money stacking space 12*b*.

When paper money is deposited, paper money deposited by a client is stacked in the first paper money stacking space 12*a* of the deposit/withdrawal unit 10. When the transfer plate 14 is moved by a driving unit and pushes the paper money against a front guide plate 15, an elevation plate 16 descends to move the deposited paper money to an upper portion of a separating unit 17. Then, the paper money is separated one by one.

Further, when the paper money is stacked in the second paper money stacking space 12*b* of the deposit/withdrawal unit 10 and the temporary storing unit 40 by stacking wheels 18, the transfer plate 14 is moved to push the paper money against the front guide plate 15.

When the paper money is stacked in the paper money stacking space 12 and moved by the transfer plate 14 as described above, there is a demand for a guide apparatus that guides the paper money so as to correspond to a width difference of paper money depending on the kinds of the paper money.

That is, paper money has different widths depending on the kinds thereof. If paper money having a small width is stacked and moved when the transfer plate 14 or the front guide plate 15 corresponds to paper money having a large width, as shown in FIG. 2B, both ends of paper money are not aligned with each other. Therefore, when the paper money is separated from each other by the separating unit 17, there is a problem in separating the paper money.

Further, when the transfer plate 14 or the front guide plate 15 corresponds to paper money having a small width, paper money having a large width cannot be stacked. Therefore, there is a problem that it is not possible to adjustably guide various kinds of paper money.

SUMMARY OF THE INVENTION

An object of the present invention is to provide a paper money guide apparatus of an ATM that can adjustably guide various kinds of paper money having different widths by a simple structure.

In order to achieve the above-mentioned object, according to an aspect of the present invention, a paper money guide apparatus of an automatic teller machine guides ends of paper money when paper money stacked in a paper money stacking space is moved by a transfer plate. The paper money guide apparatus includes paper money guide plates that each include a guide piece guiding an end of the paper money and a positioning part being detachably positioned in a width direction of the paper money depending on the width of the paper money.

In the above-mentioned apparatus, the positioning part may include an insertion portion, which protrudes forward to have a predetermined width. Further, the insertion portion may be selectively inserted into a plurality of positioning grooves arrayed at an interval corresponding to a width difference of paper money, which depends on the kinds of paper money.

Furthermore, the positioning part may include a fastening portion which is provided with fastening holes and protrudes in a direction crossing a movement direction of paper money. In addition, the fastening portion may be fixed to a side frame so that the fastening holes selectively correspond to the positioning holes.

Further, each of the paper money guide plates may include an inclined piece, which guides paper money stacked in the paper money stacking space to the guide piece.

In order to achieve the above-mentioned object, according to another aspect of the present invention, a paper money guide apparatus of an automatic teller machine guides ends of paper money stacked in a paper money stacking space. The paper money guide apparatus includes paper money guide members that each include protrusions protruding in a width direction of the paper money and insertion grooves each having a shape corresponding to the protrusions. The paper money guide members adjustably guide various kinds of paper money having different widths by detachably fixing the protrusions to insertion grooves that are formed on a side of a front guide plate or a transfer plate.

In the above-mentioned apparatus, each of the paper money guide members may include locking protrusions for preventing the separation of the paper money guide member, and locking portions into which the locking protrusions are locked.

Further, each of the paper money guide members may include a positioning protrusion that protrudes in a width direction of the paper money, and a positioning groove that has a shape corresponding to the positioning protrusion.

Furthermore, each of the protrusions may be detachably inserted into an insertion groove, which is opened at one side thereof, in a movement direction of the paper money.

DESCRIPTION OF THE PREFERRED EMBODIMENTS

Figure 1:
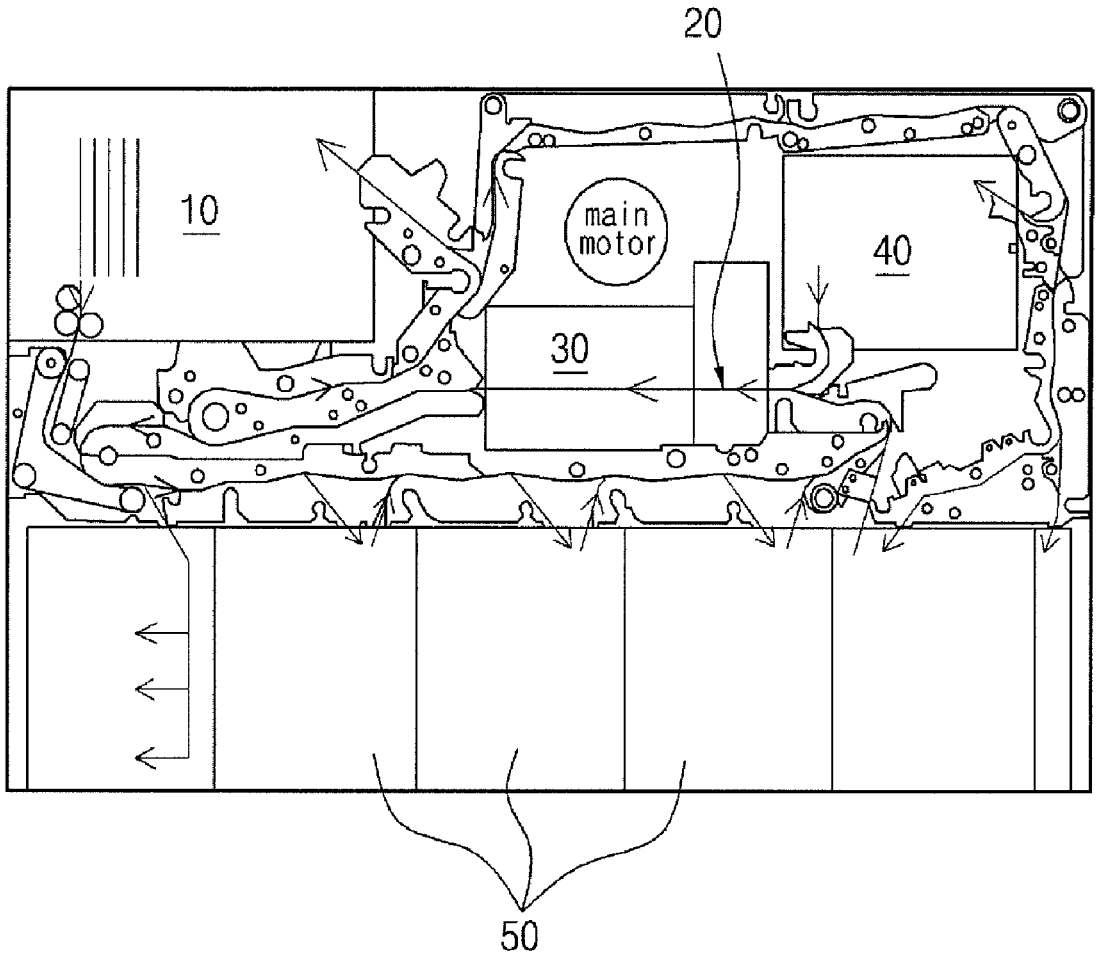
FIG 1 PRIOR ART
FIG. 1 is a schematic view showing structure of a general ATM (automatic teller machine)
Figure 2A:
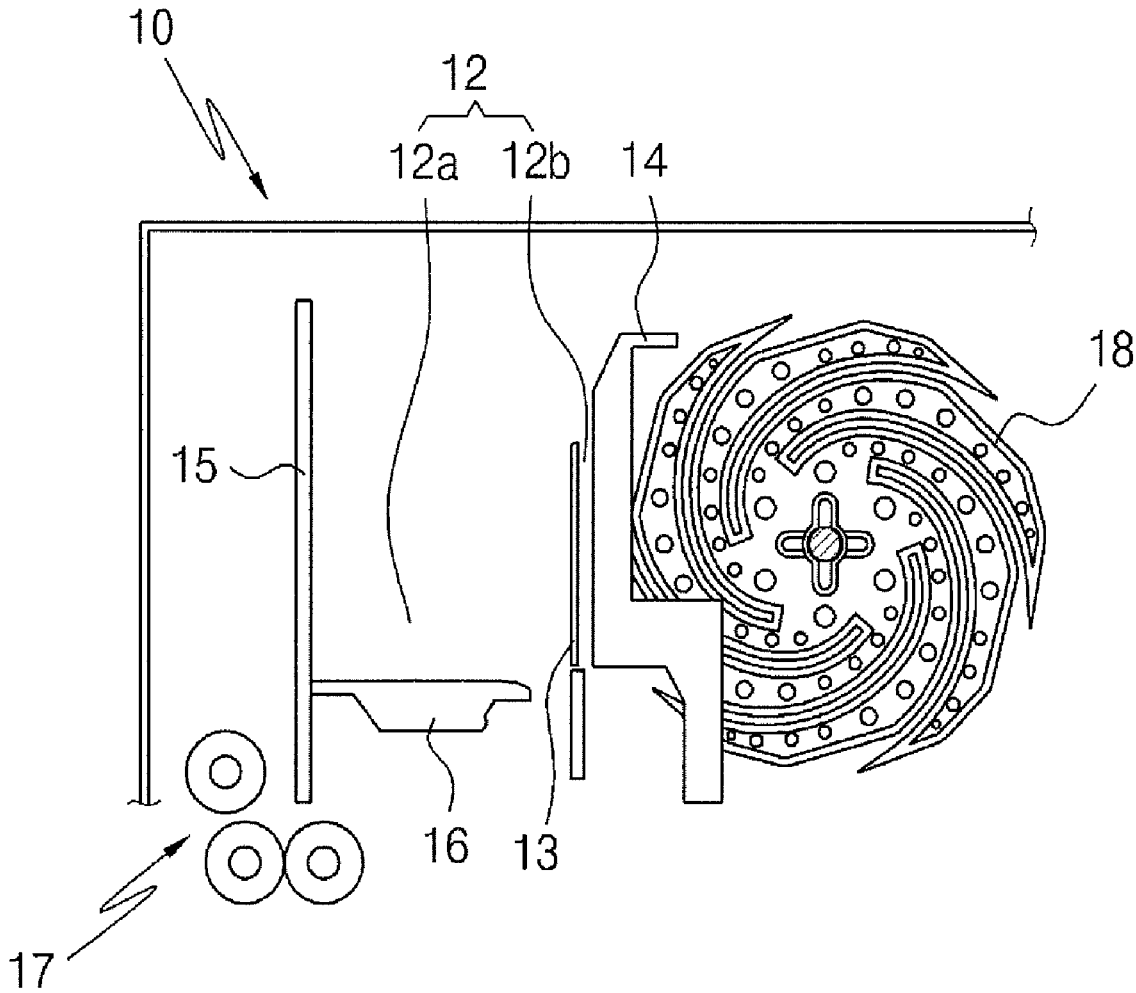
FIG 2A PRIOR ART
FIGS. 2A and 2B are schematic side and plan views of a deposit/withdrawal unit.
Figure 2B:
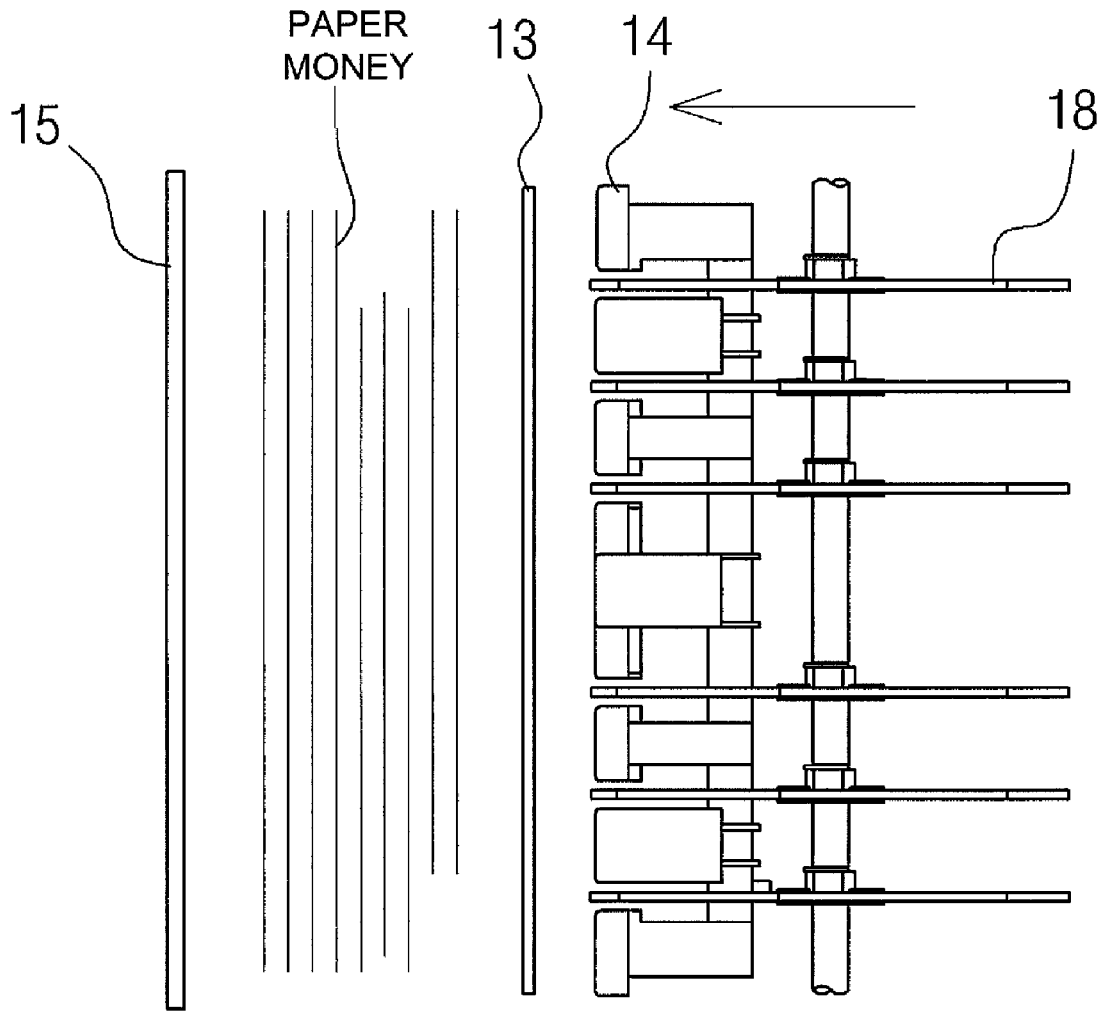
FIG 2B PRIOR ART

The structure and operation of a paper money guide apparatus according to an exemplary embodiment of the present invention will be described in detail below with reference to accompanying drawings. Elements shown in each drawing are indicated by reference numerals in this specification. Although shown in different drawings, it should be noted that the same elements are indicated by the same reference numerals if possible.

Figure 3:
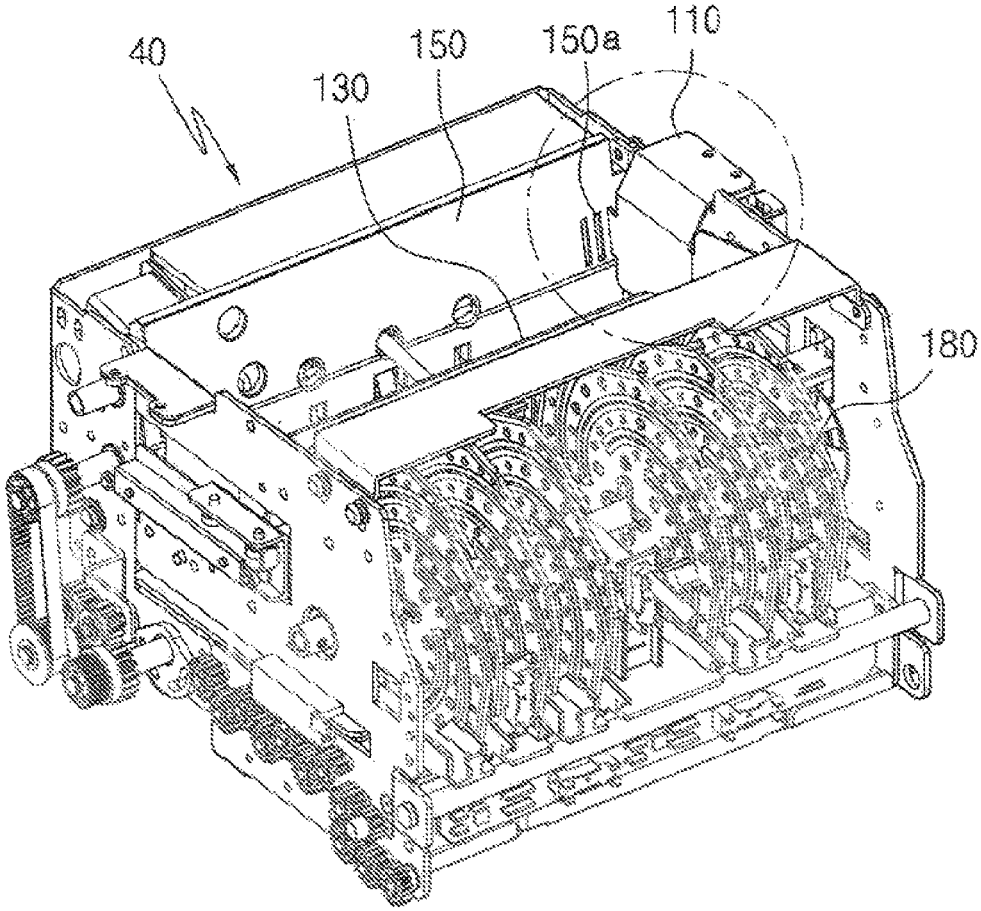
FIG. 3 is a perspective view of a paper money guide apparatus of a temporary storing unit according to an embodiment of the present invention.
Figure 4:
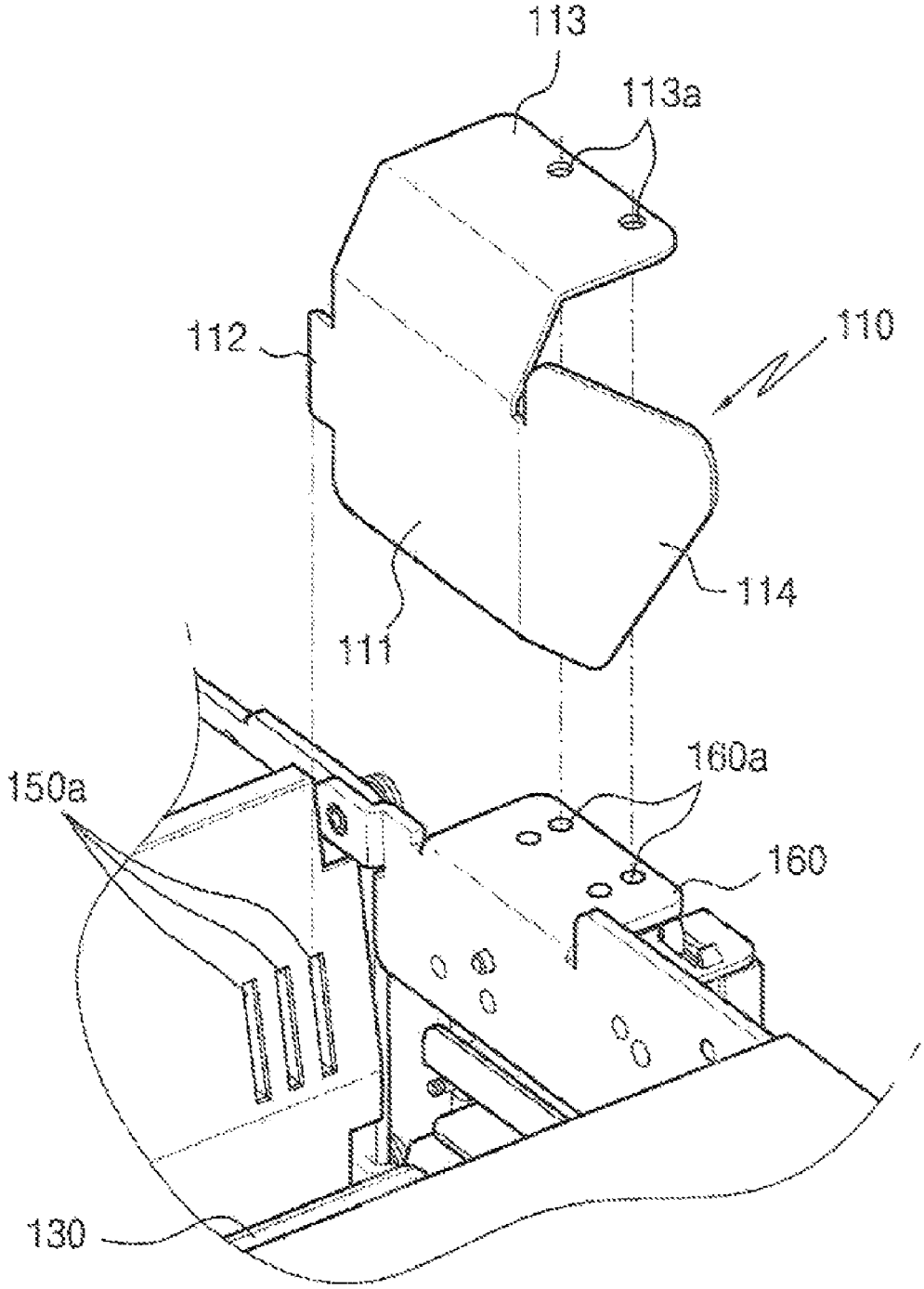
FIG. 4 is an exploded perspective view of the paper money guide apparatus shown in FIG. 3.
Figure 5A:
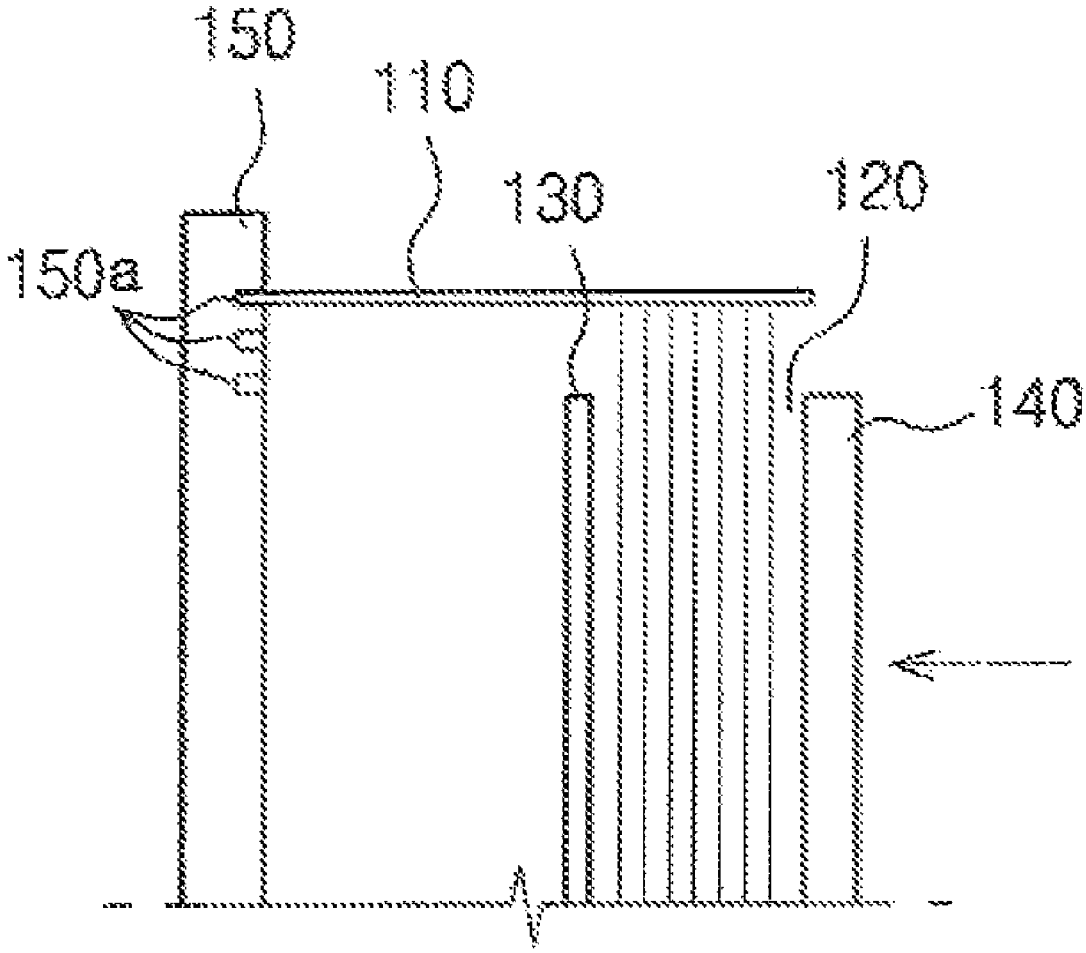
FIGS. 5A and 5B are schematic plan views showing that the position of a paper money guide plate is changed in the paper money guide apparatus shown in FIG. 3.
Figure 5B:
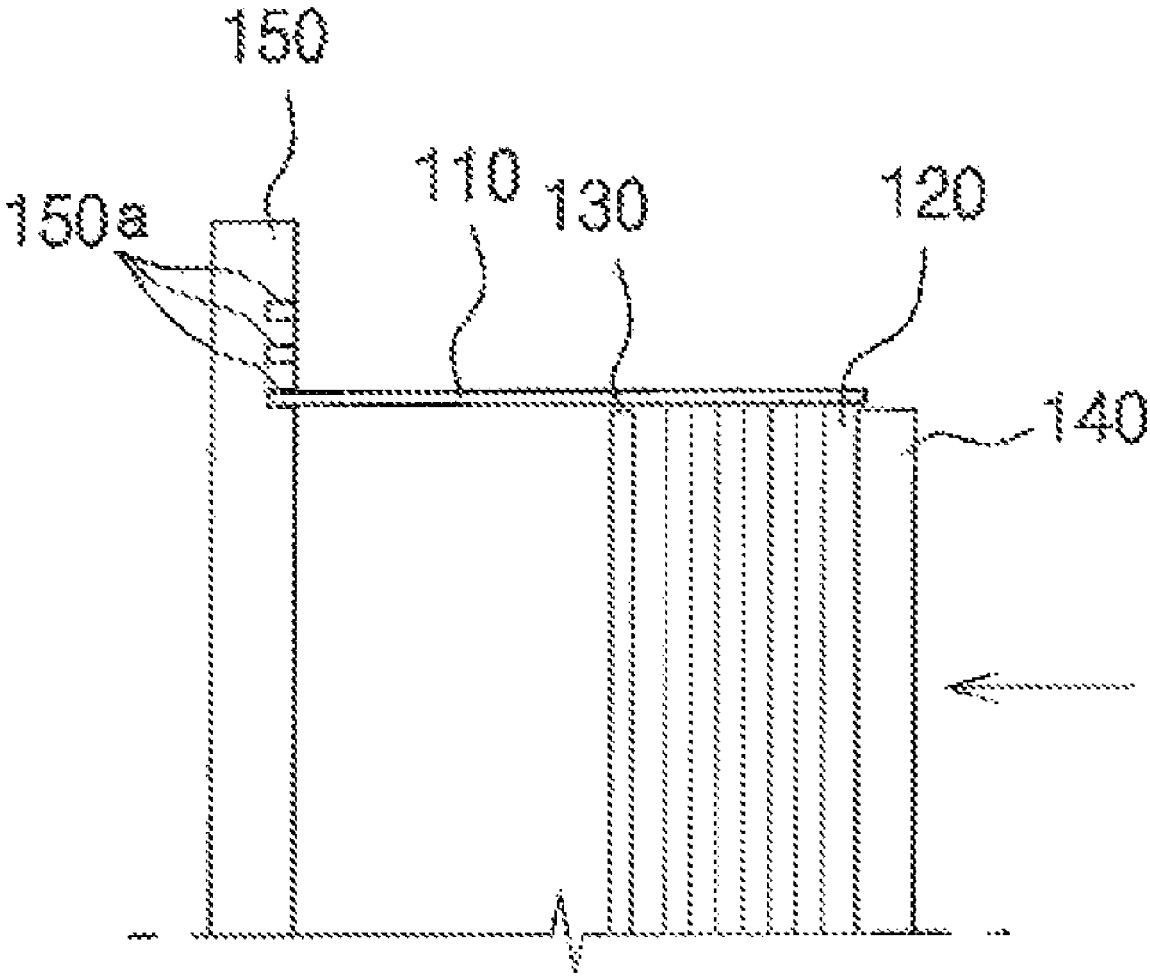

FIG. 3 is a perspective view of a paper money guide apparatus of a temporary storing unit according to an embodiment of the present invention. FIG. 4 is an exploded perspective view of the paper money guide apparatus shown in FIG. 3. FIGS. 5A and 5B are schematic plan views showing that the position of a paper money guide plate is changed in the paper money guide apparatus shown in FIG. 3.

A paper money guide apparatus according to an embodiment of the present invention may be provided in a temporary storing unit 40. Paper money, which is put into a deposit/withdrawal unit 10 by a client, is conveyed through a discriminating unit 30 and the temporarily stored in the temporary storing unit 40. If the client inputs a deposit confirmation signal to an ATM after the paper money is stored in the temporary storing unit 40, the paper money is conveyed to a recyclebox 50. In contrast, if the client inputs a deposit cancellation signal to an ATM after the paper money is stored in the temporary storing unit, the paper money is returned to the deposit/withdrawal unit 10.

The temporary storing unit 40 includes stacking wheels 180, a transfer plate 140, and a stack plate 130. The stacking wheels 180 stack paper money into a paper money stacking space 120. The transfer plate 140 moves the paper money, which is stacked by the stacking wheels 180, toward a front guide plate 150. A paper money stacking space 120 is formed the stack plate 130 and between the transfer plate 140.

When the transfer plate 140 is driven by a driving unit, the paper money stacked into the paper money stacking space 120 is moved toward the front guide plate 150. In this case, paper money guide plates 110, which guide both ends of the paper money to be moved, are provided in the temporary storing unit.

Each of the paper money guide plates 110 has a guide piece 111 that guides the end of the paper money, and a positioning part that is used to position the paper money guide plate according to the width of the paper money.

In this case, the positioning part may selectively include an insertion portion 112 and a fastening portion 113, or may include both the insertion portion 112 and the fastening portion 113. The insertion portion 112 protrudes forward from the guide piece in a movement direction of paper money and has a predetermined width. The fastening portion 113 has fastening holes 113*a* and protrudes from the guide piece in a direction crossing the movement direction of paper money.

The insertion portion 112 is inserted into one of positioning grooves 150*a* formed in the front guide plate 150. Each of the positioning grooves 150*a* is formed to have an elongated shape in a vertical direction. Further, the positioning grooves 150*a* are arrayed at an interval corresponding to a width difference of paper money, which depends on the kinds of paper money. Accordingly, it is possible to change the position of each of the paper money guide plate 110 by selectively inserting the insertion portion 112 into one of the positioning grooves 150*a*.

Two fastening holes 113*a* are formed in the fastening portion 113. Further, two positioning holes 160*a* corresponding to the fastening holes 113*a* are formed in a side frame 160 coming in contact with the lower surface of the fastening portion 113 so as to be arrayed at an interval corresponding to a width difference of paper money, which depends on the kinds of paper money. Accordingly, the fastening portion 113 is fixed to the side frame 160 by fasteners so that the fastening holes 113*a* selectively correspond to the positioning holes 160*a*. Therefore, it is possible to change the position of the paper money guide plate 110.

Meanwhile, an inclined piece 114 is formed on one side of the guide piece 111 of the paper money guide plate 110 so as to be inclined with respect to the guide piece 111. When the paper money stacked in the paper money stacking space 120 is moved toward the front guide plate 150 by the transfer plate 140, the paper money is guided by the inclined pieces 114 even though the ends of the stacked paper money are not aligned with each other. As a result, the paper money is smoothly aligned with each other.

Figure 6:
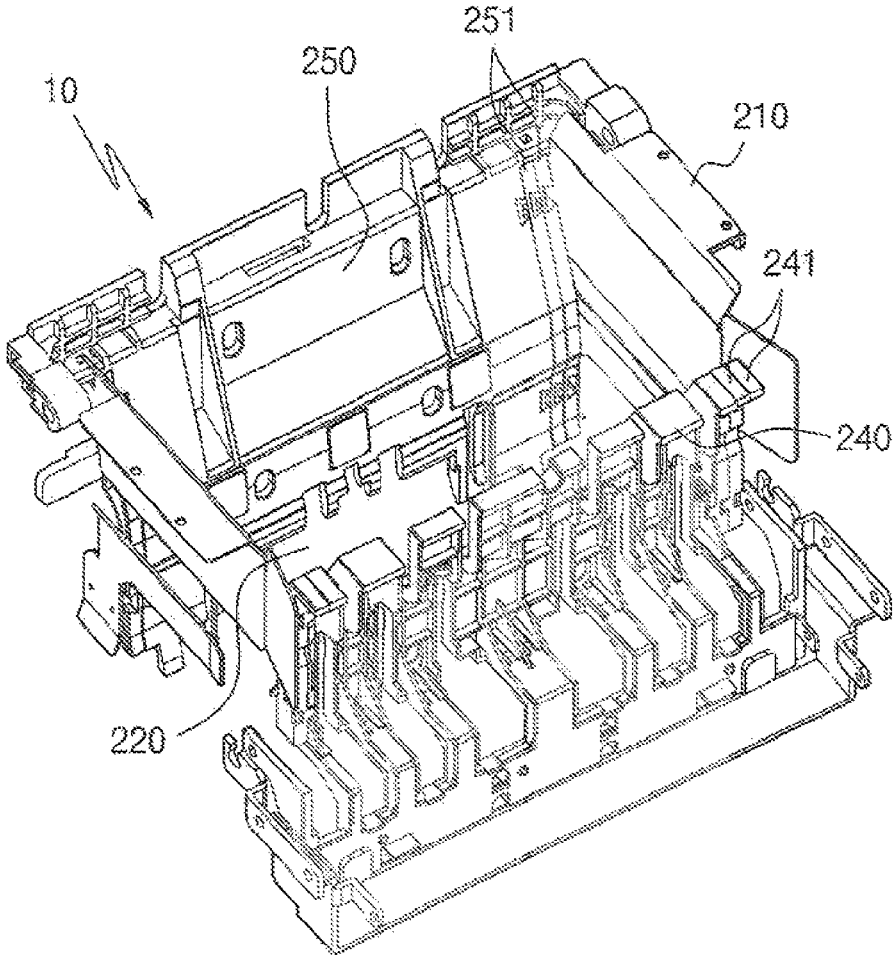
FIG. 6 is a perspective view of a deposit/withdrawal unit of a paper money guide apparatus according to another embodiment of the present invention.
Figure 7:
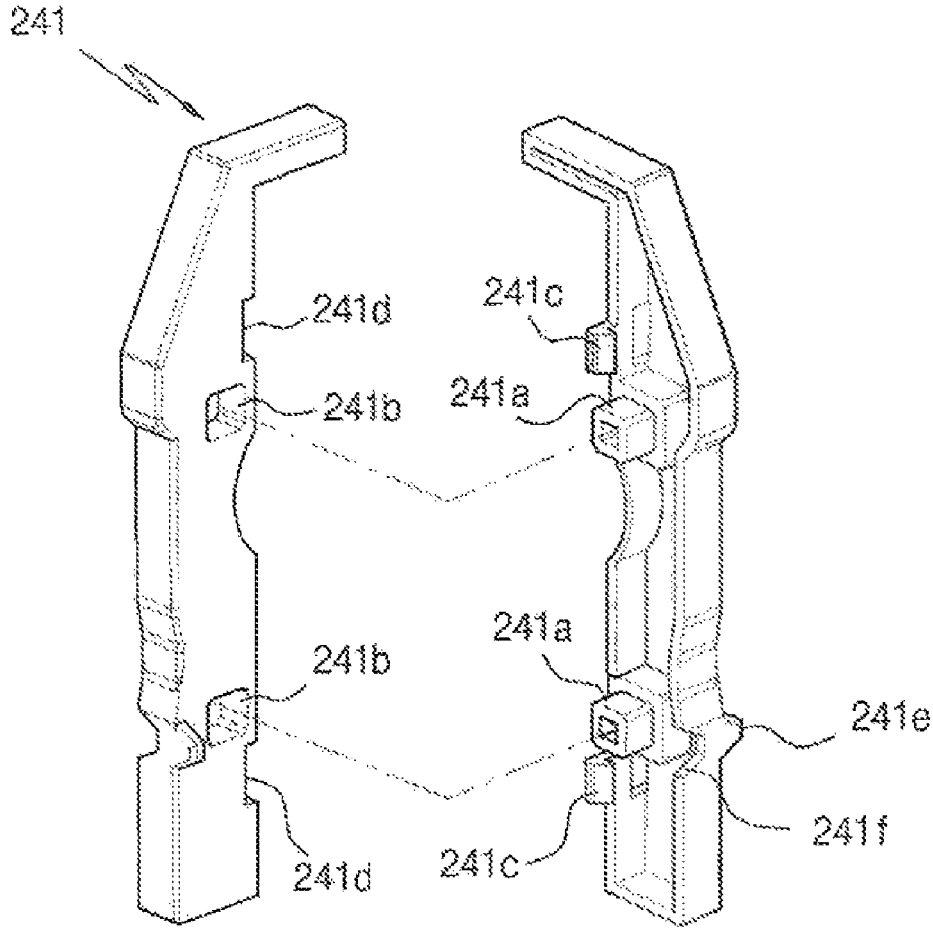
FIG. 7 is a perspective view of a paper money guide member to be fixed to the transfer plate shown in FIG. 6.
Figure 8:
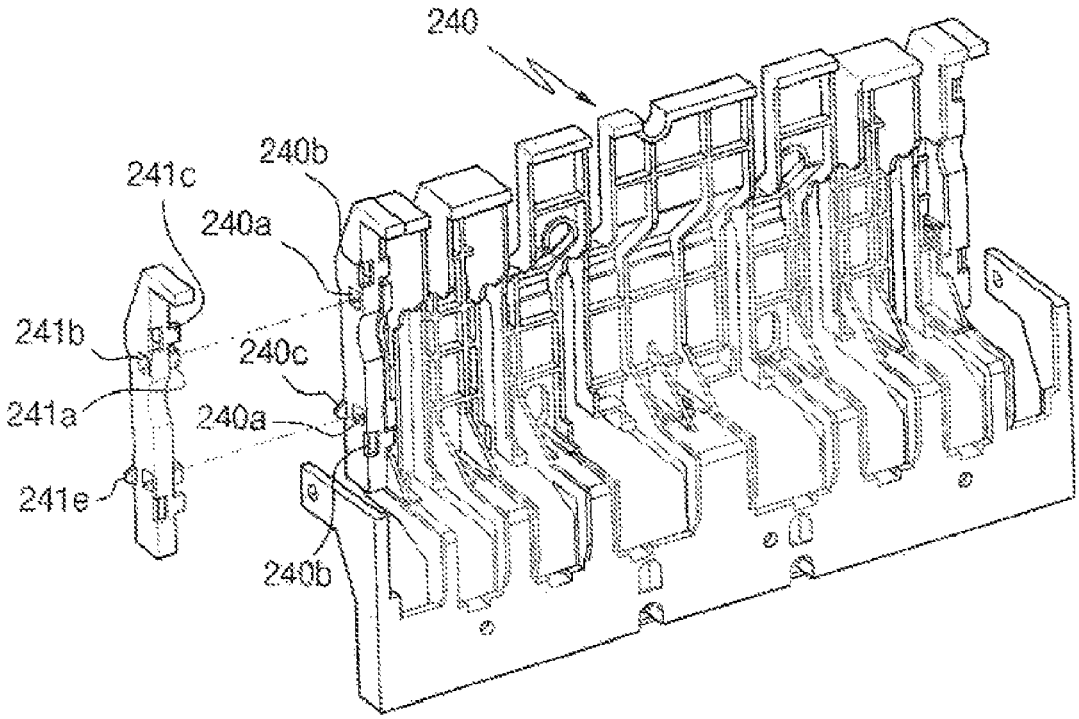
FIG. 8 is an exploded perspective view of the paper money guide apparatus provided in the transfer plate shown in FIG. 6.
Figure 9:
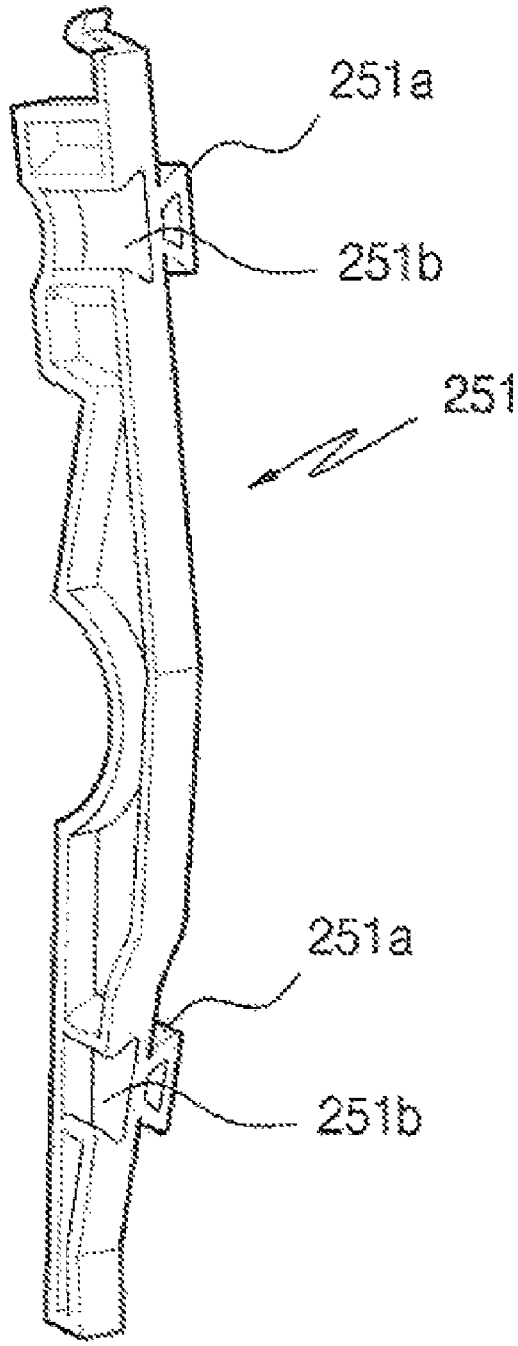
FIG. 9 is a perspective view of a paper money guide member to be fixed to a front guide plate shown in FIG. 6.
Figure 10:
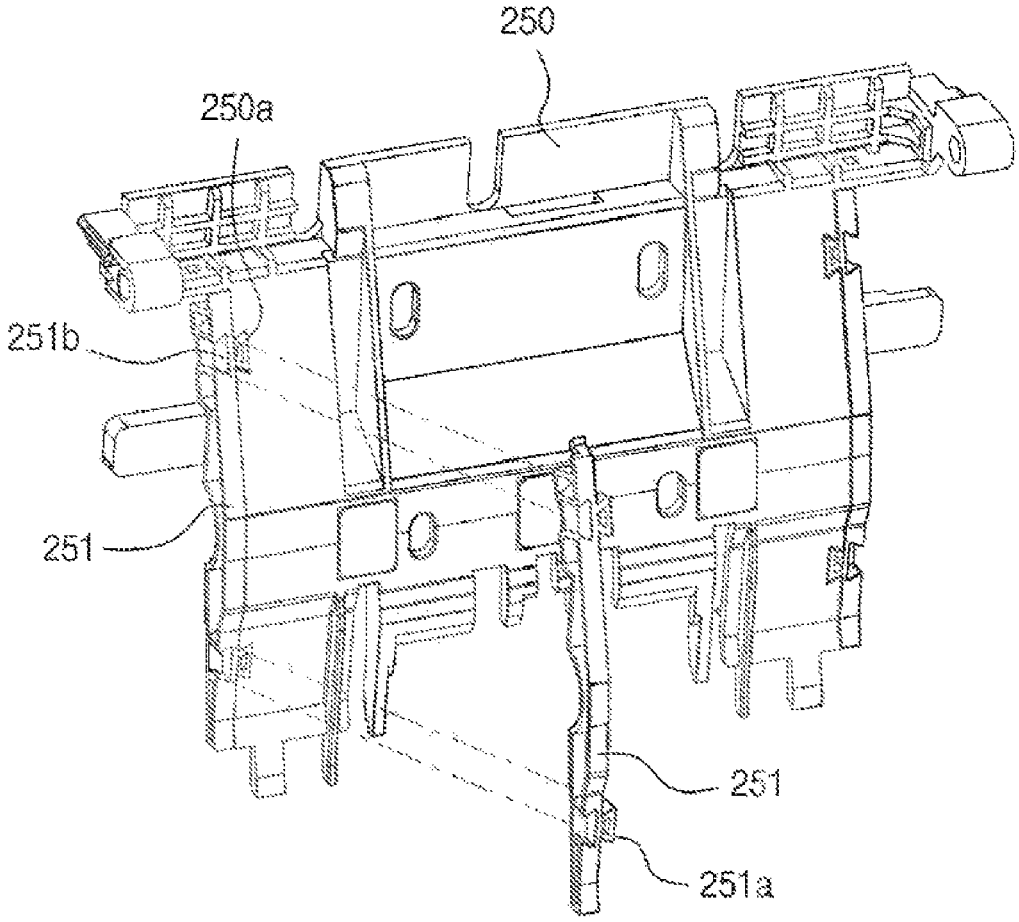
FIG. 10 is an exploded perspective view of the paper money guide apparatus provided in the front guide plate shown in FIG. 6.

FIG. 6 is a perspective view of a deposit/withdrawal unit of a paper money guide apparatus according to another embodiment of the present invention. FIG. 7 is a perspective view of a paper money guide member to be fixed to the transfer plate shown in FIG. 6. FIG. 8 is an exploded perspective view of the paper money guide apparatus provided in the transfer plate shown in FIG. 6. FIG. 9 is a perspective view of a paper money guide member to be fixed to a front guide plate shown in FIG. 6. FIG. 10 is an exploded perspective view of the paper money guide apparatus provided in the front guide plate shown in FIG. 6. FIG. 11 is a view illustrating a process where paper money is moved by a transfer plate in a deposit/withdrawal unit.

A paper money guide apparatus provided in the deposit/withdrawal unit 10 will be described with reference to FIGS. 6 to 8.

A deposit/withdrawal unit 10 is provided with a transfer plate 240 for moving paper money, which is stacked in a paper money stacking space 220 by stacking wheels (not shown), toward a front guide plate 250.

When the transfer plate 240 is driven by a driving unit, the paper money stacked into the paper money stacking space 220 is moved toward the front guide plate 250. In this case, paper money guide plates 210, which guide both ends of the paper money to be moved, are provided in a temporary storing unit.

Since each of the paper money guide plates 210 has substantially the same shape as the paper money guide plate 110 provided in the temporary storing unit 40, the position of the paper money guide plate 210 can be changed in a width direction of the paper money so as to correspond to a width difference of paper money, which depends on the kinds of paper money.

Paper money guide members 241, which are easily attached and detached so as to correspond to the width of paper money, are provided on the side transfer plate 240. Each of the paper money guide members 241 has a width of, for example, 5 mm. When the width of the paper money is changed, the paper money guide members 241, of which the number corresponds to the changed width of the paper money, are provided on the side of the transfer plate 240. Accordingly, even though the kind of paper money is changed, it is possible to adjustably guide the paper money.

An example of the paper money guide member 241 will be described with reference to FIG. 7. The paper money guide member 241 includes two protrusions 241*a* that protrude in a width direction of the paper money and each have a quadrangular cross-section, and two insertion grooves 241*b* that each have a shape corresponding to the protrusion 241*a*. The protrusions 241*a* are inserted into insertion grooves 240*a* which are formed on the side of the transfer plate 240.

Further, locking protrusions 241*c* are formed on the outer side of the protrusions 241*a* in a longitudinal direction of the paper money guide member 241 in order to prevent the paper money guide member 241 from being separated from the transfer plate 240. The locking protrusions 241*c* are locked to locking portions 240*b* of the transfer plate 240, or locking portions 241*d* of another paper money guide member 241.

Meanwhile, the paper money guide member 241 includes a positioning protrusion 241*e* that protrudes from the paper money guide member 241 in a width direction of the paper money, and a positioning groove 241*f* that has a shape corresponding to the positioning protrusion 241*e*. Accordingly, it is possible to easily fix the paper money guide member 241 fixed to the transfer plate 240 or another paper money guide member 241.

Referring to FIG. 8, when the width of the paper money to be processed is changed, the paper money guide members 241 are fixed to the transfer plate 240 so as to correspond to the changed width of the paper money. The transfer plate 240 includes insertion grooves 240*a* into which the protrusions 241*a* of the paper money guide member 241 are inserted, a locking portion 240*b* to which the locking protrusion 241*c* of the paper money guide member 241 is locked, and a positioning protrusion 240*c* to be inserted into the positioning groove 241*f*.

Referring to FIGS. 9 and 10, paper money guide members 251 are provided on the side of the front guide plate 250.

Each of the paper money guide members 251 includes protrusions 251*a* that protrude in a width direction of the paper money and each have a trapezoid shape, and insertion grooves 251*b* that each have a shape corresponding to the protrusion 251*a*. Meanwhile, the front guide plate 250 also includes insertion grooves 250*a*.

Each of the insertion grooves 251*b* is opened at one side thereof. The protrusion 251*a* is inserted into the opened side of the insertion groove and separated from the insertion groove through the opened side. The paper money guide member can be attached to and detached from the front guide plate 250 or another money guide member 251.

The paper money guide members 241 and 251 can be attached and detached as described above. Accordingly, even when the width of the paper money is small or large, it is possible to adjustably guide the paper money.

Figure 11A:
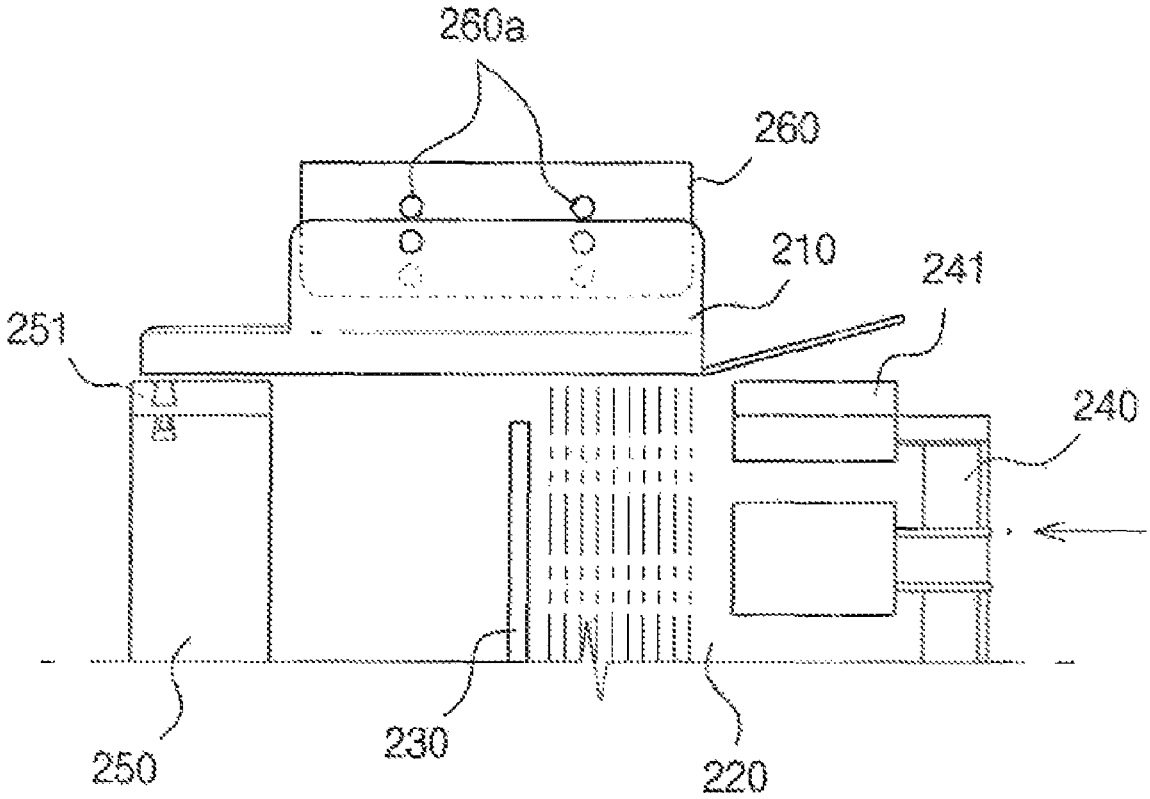
FIG. 11 is a view illustrating a process where paper money is moved by a transfer plate in a deposit/withdrawal unit.

Referring to FIG. 11, as shown in FIG. 11A, paper money having a large width is stacked in a stacking space 220, which is formed between the transfer plate 240 and a stack plate 230. The end of the paper money is guided by the paper money guide plate 210. The paper money guide plate 210 is fixed to the side frame 260 by fasteners (not shown) so that fastening holes 213*a* formed in the paper money guide plate correspond to positioning holes 260*a* of the side frame. Therefore, it is possible to change the position of the paper money guide plate 210. In this case, the paper money guide member 241 is provided on one side of the transfer plate 240, and the paper money guide member 251 is also provided on one side of the front guide plate 250.

Figure 11B:
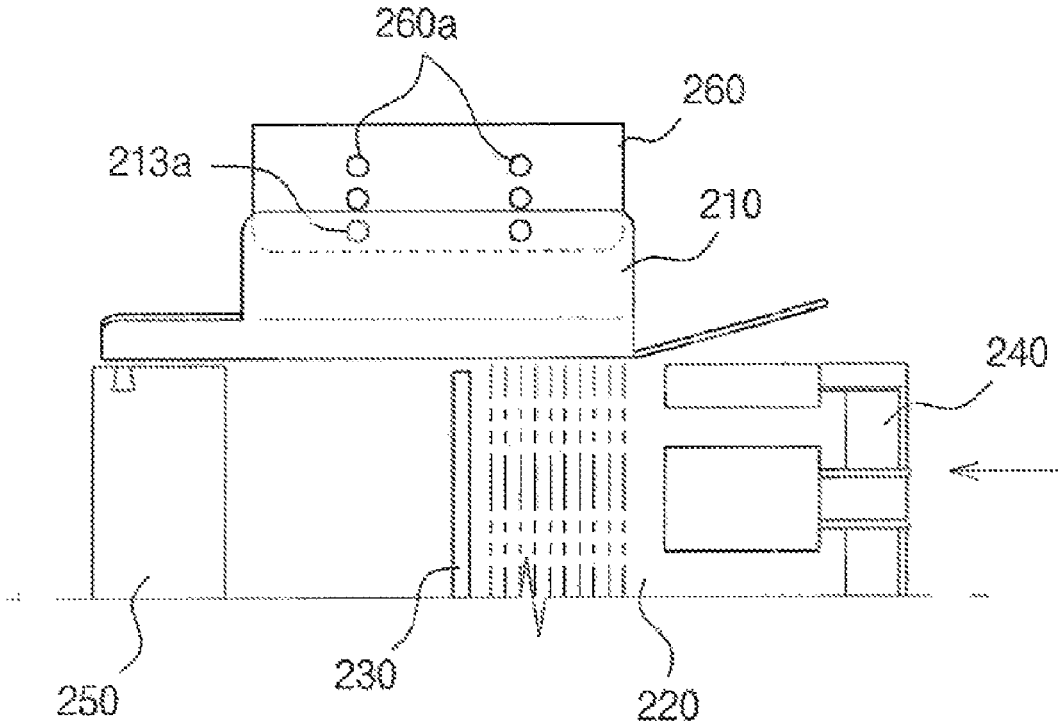

When the width of the paper money stacked in the paper money stacking space 220 is small, the paper money guide members 241 and 251, which are provided on the sides of the transfer plate 240 and the front guide plate 250, are removed as shown in FIG. 11B. Then, the paper money guide plate 210 is positioned to correspond to other positioning hole 260*a* so that the position of the paper money guide plate is changed.

As described above, the paper money guide apparatus of an ATM according to the embodiment of the present invention, makes it possible to adjustably guide various kinds of paper money having different widths by a simple structure in a deposit/withdrawal unit or a temporary storing unit. Further, even when the width of the paper money is small or large, it is possible to adjustably guide the paper money. As a result, it is possible to efficiently use an ATM.

What is claimed is:

1. A paper money guide apparatus of an automatic teller machine that guides side ends of paper money stacked in a paper money stacking space between a front guide plate and a transfer plate, the transfer plate being moved by a driving unit and pushing paper stacked in the paper money stacking space toward the front guide plate, the paper money guide apparatus comprising:

paper money guide plates that each include a guide piece guiding an end of paper money and a positioning part being detachably positioned in a width direction of paper money depending on the width of the paper money; and paper money guide members with the same size that each include first protrusions protruding in the width direction of paper money and first insertion grooves each having a shape corresponding to the first protrusions, the paper money guide members adjustably guiding various kinds of paper money having different widths by detachably fixing at least one of the first protrusions to second insertion grooves that are formed on a side of the front guide plate or the transfer plate, and wherein the positioning part includes an insertion portion which protrudes forward to have a predetermined width, the insertion portion being selectively inserted into a plurality of first positioning grooves arrayed at the front guide plate with an interval corresponding to a width difference of paper money, which depends on the kinds of paper money, and wherein when the width of paper money is changed, the paper money guide members, a number of which correspond to the changed width of paper money, are assembled with each other and fixed at the second insertion grooves of the front guide plate or the transfer plate.

2. The paper money guide apparatus according to claim 1, wherein the positioning part of a paper money guide plate includes a fastening portion which is provided with fastening holes and protrudes in a direction crossing a movement direction of paper money, and the fastening portion is fixed to a side frame so that the fastening holes correspond to positioning holes of the side frame.

3. The paper money guide apparatus according to claim 1, wherein each of the paper money guide plates includes an inclined piece which guides paper money stacked in the paper money stacking space to the guide piece.

4. The paper money guide apparatus according to claim 1, wherein each of the paper money guide members includes locking protrusions for preventing separation of the paper money guide member, and locking portions into which the locking protrusions are locked.

5. The paper money guide apparatus according to claim 1, wherein each of the paper money guide members includes a second protrusion that protrudes in the width direction of paper money, and a second positioning groove that has a shape corresponding to the second protrusion.

6. The paper money guide apparatus according to claim 1, wherein the first protrusion of a first paper money guide member is detachably inserted into the first insertion groove of a second paper money guide member.

* * * * *